US006383310B1

(12) United States Patent
Otsuka et al.

(10) Patent No.: US 6,383,310 B1
(45) Date of Patent: May 7, 2002

(54) EXHAUST EQUIPMENT MEMBER, INTERNAL COMBUSTION ENGINE SYSTEM USING SAME, AND METHOD FOR PRODUCING SUCH EXHAUST EQUIPMENT MEMBER

(75) Inventors: Koki Otsuka; Kenji Itoh; Keijiro Hayashi, all of Tochigi-ken; Norio Takahashi, Saitama-ken, all of (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 09/543,755

(22) Filed: Apr. 5, 2000

(30) Foreign Application Priority Data

Apr. 5, 1999 (JP) ..... 11-097136

(51) Int. Cl.[7] ..... C22C 38/40; C22C 38/60

(52) U.S. Cl. ..... 148/327; 420/42; 420/55; 60/272

(58) Field of Search ..... 148/327; 420/42, 420/52, 55; 60/272, 299

(56) References Cited

U.S. PATENT DOCUMENTS 3,826,689 A * 7/1974 Ohta et al. ..... 148/327
3,969,109 A * 7/1976 Tancyn ..... 148/327
5,021,215 A * 6/1991 Sawaragi et al. ..... 420/55
5,194,220 A 3/1993 Takahashi et al. ..... 420/55
5,489,416 A 2/1996 Takahashi et al. ..... 420/42
5,501,835 A * 3/1996 Watanabe et al. ..... 420/55

FOREIGN PATENT DOCUMENTS

| | | |
|---|---|---|
| JP | 53-48916 | 5/1978 |
| JP | 54-96418 | 7/1979 |
| JP | 5/5161 | 1/1993 |
| JP | 7-228948 | 8/1995 |
| JP | 7-278759 | 10/1995 |

* cited by examiner

*Primary Examiner*—George Wyszomierski
(74) *Attorney, Agent, or Firm*—Sughrue Mion, PLLC

(57) ABSTRACT

An exhaust equipment member having an exhaust gas path portion at least partially having a thickness of 5 mm or less is made of a heat-resistant, high-Cr, high-Ni, austenitic cast steel having weight ratios of Cr/Ni of 1.0–1.5 and Mn/S of 5 or more a composition by weight of 0.2–1.0% of C, 2% or less of Si, 2% or less of Mn, 0.04% or less of P, 0.05–0.25% of 5, 20–30% of Cr, and 16–30% of Ni, the balance being substantially Fe and inevitable impurities, with a weight loss by oxidation of 50 mg/cm2 or less when kept in the air at 10100 C. for 200 hours.

26 Claims, 6 Drawing Sheets

EXHAUST EQUIPMENT MEMBER, INTERNAL COMBUSTION ENGINE SYSTEM USING SAME, AND METHOD FOR PRODUCING SUCH EXHAUST EQUIPMENT MEMBER

FIELD OF THE INVENTION

The present invention relates to an exhaust equipment member such as an exhaust manifold, a turbine housing, etc. for automobile engines, an internal combustion engine system using such an exhaust equipment member, and a method for producing such an exhaust equipment member.

Prior Art

Exhaust equipment members such as exhaust manifolds, turbine housings, etc. for automobiles are conventionally made of heat-resistant cast iron such as NI-RESIST cast iron (Ni—Cr—Cu austenitic cast iron), heat-resistant ferritic cast steel, etc. Though the NI-RESIST cast iron has relatively good high-temperature strength at an exhaust gas temperature of up to 900° C., it does not have enough durability at a temperature of 900° C. or higher. Also, the heat-resistant ferritic cast steel is poor in a high-temperature strength at an exhaust gas temperature of 950° C. or higher.

There is a heat-resistant, austenitic cast steel as a material more resistant to a high temperature than heat-resistant cast iron such as NI-RESIST cast iron and heat-resistant ferritic cast steel. For instance, Japanese Patent Laid-Open No. 54-96418 discloses a heat-resistant, austenitic cast steel comprising by weight 0.1–1.5% of C, 0.5–5.0% of Si, less than 2.5% of Mn, 15–35% of Cr, and 8–45% of Ni, 0.5–3.0% of W, 0.2–5.0% of Nb, or further 0.5–2.0% of Mo and 0.05–0.25% of S, the balance being substantially Fe. This Japanese laid-open application shows in Examples a heat-resistant, austenitic cast steel having a composition comprising by weight 0.12–1.42% of C, 0.23–0.73% of Si, 0.77–0.83% of Mn, 0.87–1.62% of Mo, 24.8–25.3% of Cr, 19.6–20.3% of Ni, 0.86–1.6% of W, 0.21–1.33% of Nb, and 0.08–16% of S, the balance being substantially Fe. Because this cast steel contains S, it exhibits improved cuttability, a high-temperature tensile strength of 10.6–15.4 kg/mm$^2$ at 1000° C., and a weight loss by oxidation of 1.7–8.3 mg/(dm$^2$·hr) at 900° C.

The present applicant proposed heat-resistant, austenitic cast steels durable in use at a high temperature of 900° C. or higher (Japanese Patent Laid-Open Nos. 5-5161 and 7-228948).

Japanese Patent Laid-Open No. 5-5161 discloses a heat-resistant, austenitic cast steel having a composition comprising by weight 0.20–0.60% of C, 2.00% or less of Si, 1.00% or less of Mn, 15–30% of Cr, 8–20% of Ni, 2–6% of W, 0.2–1.0% of Nb, and 0.001–0.01% of B, the balance being substantially Fe and inevitable impurities, which has excellent high-temperature strength even after subjected to repeated heat cycles of heating up to higher than 900° C. and cooling, and an exhaust equipment member made of such heat-resistant austenitic cast steel. This Japanese laid-open application shows in EXAMPLE a composition comprising by weight 0.19–0.49% of C, 0.87–1.06% of Si, 0.46–0.59% of Mn, 18.82–28.20% of Cr, 8.26–18.84% of Ni, 2.02–5.03% of W, 0.28–0.98% of Nb, and 0.002–0.008% of B, the balance being substantially Fe and inevitable impurities, or further 0.49–0.55% of Mo and/or 4.50–18.74% of Co. EXAMPLES of this Japanese laid-open application show that the heat-resistant austenitic cast steel had a 0.2-% yield strength of 33–62 MPa, a tensile strength of 59–31 MPa and an elongation of 27–40% at 1050° C. Also, they show that when the thermal fatigue life of this austenitic cast steel was measured on a round rod test piece having a gauge length of 20 mm and a diameter of 10 mm in the gauge length under the conditions of the lowest heating temperature of 150° C., the highest heating temperature of 1000° C., and each one cycle of 12 minutes in a state where the elongation and shrink of the test piece by heating were mechanically completely constrained, the number of cycles was 88–195 until the thermal fatigue failure took place. Further, they show that the weight loss by oxidation after kept at 1000° C. for 200 hours was 15–50 mg/cm$^2$.

Japanese Patent Laid-Open No. 7-228948 discloses a heat-resistant, austenitic cast steel with excellent castability and cuttability having a composition comprising by weight 0.2–1.0% of C, 2% or less of Si, 2% or less of Mn, 15–30% of Cr, 8–20% of Ni, 1–6% of W, 0.5–6% of Nb, 0.01–0.3% of N, and 0.01–0.5% of S, C—Nb/8 being 0.05–0.6%, and the balance being substantially Fe and inevitable impurities, and an exhaust equipment member made of such austenitic cast steel. This Japanese laid-open application shows in EXAMPLE a composition comprising by weight 0.21–0.80% of C, 0.52–1.11% of Si, 0.51–1.05% of Mn, 16.55–21.02% of Cr, 8.45–18.55% of Ni, 1.02–5.80% of W, 0.68–6.95% of Nb, 0.03–0.14% of N, and 0.03–0.41% of S, C—Nb/8 being 0.12–0.58%, and the balance being substantially Fe and inevitable impurities. The heat-resistant austenitic cast steel in this EXAMPLE had a 0.2-% yield strength of 55–80 MPa, a tensile strength of 62–125 MPa and an elongation of 26–75% at 1000° C. Also, when the thermal fatigue life of this austenitic cast steel was measured on a round rod test piece having a gauge length of 25 mm and a diameter of 10 mm in the gauge length under the conditions of the lowest heating temperature of 150° C., the highest heating temperature of 1000° C., and each one cycle of 12 minutes in a state where the elongation and shrink of the test piece by heating were mechanically completely constrained, the number of cycles was 145–210 until the thermal fatigue failure took place. Further, it exhibited a weight loss by oxidation of 18–50 mg/cm$^2$ when kept in the air at 1000° C. for 200 hours.

In most automobile engines, gasoline is mixed with air in an intake manifold or a collector as an air-intake member and then supplied to a combustion chamber of the engine. In this structure, if gasoline or a mixture of gasoline and air leaks from the intake manifold or the collector by the collision of an automobile, it may be ignited. To prevent such an accident, air-intake members such as an intake manifold or a collector are connected to the engine on the rear side, while exhaust equipment members such as an exhaust manifold and a turbine housing are connected to the engine on the front side.

Recently, further reduction of an exhaust gas and improvement in fuel efficiency are increasingly demanded for the purpose of maintaining global environment. Thus, progress has been achieved in increase in the output of engines and the combustion temperature, resulting in the development and wide spreading of so-called direct-injection engines having combustion chambers into which gasoline is directly injected. In this direct-injection engine, because gasoline is directly introduced into a combustion chamber from a fuel tank, only the slightest amount of gasoline would leak if the automobile collided, resulting in little likelihood that the collision leads to a large accident. Accordingly, instead of the conventional arrangement that the exhaust equipment members such as an exhaust manifold and a turbine housing are disposed in front of the engine while the air-intake members such as an intake manifold or a collector are disposed on the rear side of the engine, the air-intake members may be disposed in front of the engine to supply a cooled air to the combustion chamber of the engine, while the exhaust equipment members are disposed on the rear side of the engine, so that they are directly connected to an exhaust gas-purifying apparatus to improve the initial performance of an exhaust gas-purifying catalyst in the exhaust gas-purifying apparatus.

When the exhaust equipment members such as an exhaust manifold and a turbine housing are disposed on the rear side of the engine, the surface temperatures of the exhaust equipment members are elevated because the exhaust equipment members are less likely to be brought into contact with the wind during the driving of an automobile. Thus, the exhaust equipment members need high durability at a high temperature.

The exhaust equipment members such as an exhaust manifold and a turbine housing are presently required to have enough durability to an exhaust gas at temperatures exceeding 1000° C., or near 1050° C., or further near 1100° C. Further, to ensure the initial performance of an exhaust gas-purifying catalyst at the time of starting the engine, the exhaust equipment members should be as thin as possible.

The heat-resistant, austenitic cast steel disclosed in Japanese Patent Laid-Open No. 54-96418 exhibits a weight loss by oxidation of 1.7–8.3 mg/(dm$^2$·hr) at 900° C. and a tensile strength of 10.6–15.4 kg/mm$^2$ at 1000° C. Also, the heat-resistant, austenitic cast steel disclosed in Japanese Patent Laid-Open No. 5-5161 exhibits a weight loss by oxidation of 15–50 mg/cm$^2$ after kept at 1000° C. for 200 hours. Further, the heat-resistant, austenitic cast steel disclosed in Japanese Patent Laid-Open No. 7-228948 exhibits a weight loss by oxidation of 18–50 mg/cm$^2$ after kept at 1000° C. for 200 hours. However, exhaust equipment members exposed to an exhaust gas at a temperature exceeding 1000° C. are neither disclosed nor suggested in any of these Japanese patents.

OBJECT AND SUMMARY OF THE INVENTION

Accordingly, an object of the present invention is to provide an exhaust equipment member having excellent durability even when exposed to an exhaust gas at a temperature exceeding 1000° C. or near 1050° C. or further near 1100° C., which may be thin and disposed on the rear side of an engine to improve the initial performance of an exhaust gas-purifying catalyst.

Another object of the present invention is to provide an internal combustion engine system comprising such an exhaust equipment member.

A further object of the present invention is to provide a method for producing such an exhaust equipment member.

The inventors have investigated how to improve high-temperature characteristics such as oxidation resistance and thermal fatigue life by changing the amounts of C, Cr, Ni, S, W, Nb, etc. added to a basic composition of a heat-resistant, high-Cr, high-Ni, austenitic cast steel. As a result, they have found that not only a high-temperature strength but also oxidation resistance are important factors to improve the durability of the exhaust equipment member exposed to an exhaust gas at a temperature exceeding 1000° C. Specifically, when the exhaust equipment member is oxidized by exposure to a high-temperature exhaust gas, fine cracks are generated thereon, functioning as starting sites of oxidation, resulting in further generation of fine cracks. This mechanism occurs repeatedly to generate large cracks, which determines the durability of the exhaust equipment member.

To suppress the oxidation of the exhaust equipment member as much as possible, it has been found that the composition of the heat-resistant, high-Cr, high-Ni, austenitic cast steel having weight ratios of Cr/Ni of 1.0–1.5 and Mn/S of 5 or more, particularly a weight ratio of Cr/Ni should be optimized, thereby precipitating fine carbide particles based on chromium in the austenitic matrix to improve oxidation resistance. Thus, it is possible to obtain an exhaust equipment member having an exhaust gas path portion at least partially having a thickness of 5 mm or less, and having excellent durability even when exposed to an exhaust gas at a temperature exceeding 1000° C. or near 1050° C. or further near 1100° C. It has also been found that by vacuum casting with a sand mold, a melt of the heat-resistant, high-Cr, high-Ni, austenitic cast steel having weight ratios of Cr/Ni of 1.0–1.5 and Mn/S of 5 or more can flow well to form an exhaust gas path portion at least partially as thin as 5 mm or less. It has further been found that by disposing the above exhaust equipment member on the rear side of the engine, an exhaust gas-purifying catalyst arranged downstream of the exhaust equipment member can exhibit improved initial performance. The present invention has been completed based upon these findings.

Thus, the exhaust equipment member according to the first embodiment of the present invention has an exhaust gas path portion at least partially having a thickness of 5 mm or less, the exhaust equipment member being made of a heat-resistant, high-Cr, high-Ni, austenitic cast steel having weight ratios of Cr/Ni of 1.0–1.5 and Mn/S of 5 or more, with a weight loss by oxidation of 50 mg/cm$^2$ or less when kept in the air at 1010° C. for 200 hours.

The exhaust equipment according to the second embodiment of the present invention has an exhaust gas path portion at least partially having a thickness of 5 mm or less, the exhaust equipment member being made of a heat-resistant, high-Cr, high-Ni, austenitic cast steel having weight ratios of Cr/Ni of 1.0–1.5 and Mn/S of 5 or more, with a weight loss by oxidation of 100 mg/cm$^2$ or less when kept in the air at 1050° C. for 200 hours.

The exhaust equipment member according to the third embodiment of the present invention has an exhaust gas path portion at least partially having a thickness of 5 mm or less, the exhaust equipment member being made of a heat-resistant, high-Cr, high-Ni, austenitic cast steel having weight ratios of Cr/Ni of 1.0–1.5 and Mn/S of 5 or more, with a weight loss by oxidation of 200 mg/cm$^2$ or less when kept in the air at 1100° C. for 200 hours.

The exhaust equipment member according to the fourth embodiment of the present invention has an exhaust gas path portion at least partially having a thickness of 5 mm or less, the exhaust equipment member being made of a heat-resistance, high-Cr, high-Ni, austenitic cast steel having weight ratios of Cr/Ni of 1.0–1.5 and Mn/S of 5 or more, with a weight loss by oxidation of 50 mg/cm$^2$ or less when kept in the air at 1010° C. for 200 hours, and 100 mg/cm$^2$ or less when kept in the air at 1050° C. for 200 hours.

The exhaust equipment member according to the fifth embodiment of the present invention has an exhaust gas path portion at least partially having a thickness of 5 mm or less, the exhaust equipment member being made of a heat-resistant, high-Cr, high-Ni, austenitic cast steel having weight ratios of Cr/Ni of 1.0–1.5 and Mn/S of 5 or more, with a weight loss by oxidation of 100 mg/cm$^2$ or less when kept in the air at 1050° C. for 200 hours, and 200 mg/cm$^2$ or less when kept in the air at 1100° C. for 200 hours.

The exhaust equipment member according to the sixth embodiment of the present invention has an exhaust gas path portion at least partially having a thickness of 5 mm or less, the exhaust equipment member being made of a heat-resistant, high-Cr, high-Ni, austenitic cast steel having weight ratios of Cr/Ni of 1.0–1.5 and Mn/S of 5 or more, with a weight loss by oxidation of 50 mg/cm$^2$ or less when kept in the air at 1010° C. for 200 hours, 100 mg/cm$^2$ or less when kept in the air at 1050° C. for 200 hours, and 200 mg/cm$^2$ or less when kept in the air at 1100° C. for 200 hours.

Any of the above exhaust equipment members preferably has a thermal fatigue life of 200 cycles or more in a thermal fatigue test in which heating and cooling are repeated under the conditions of the highest heating temperature of 1000° C., a temperature amplitude of 800° C. or more and a constraint ratio of 0.25.

Any of the above exhaust equipment members preferably has a thermal fatigue life of 100 cycles or more in a thermal fatigue test in which heating and cooling are repeated under the conditions of the highest heating temperature of 1000° C., a temperature amplitude of 800° C. or more and a constraint ratio of 0.5.

In any of the above exhaust equipment members, the heat-resistant, high-Cr, high-Ni, austenitic cast steel having weight ratios of Cr/Ni of 1.0–1.5 and Mn/S of 5 or more preferably has a composition by weight comprising 0.2–1.0% of C, 2% or less of Si, 2% or less of Mn, 0.04% or less of P, 0.05–0.25% of 5, 20–30% of Cr, and 16–30% of Ni, the balance being substantially Fe and inevitable impurities. The more preferred composition of the heat-resistant, high-Cr, high-Ni, austenitic cast steel comprises by weight 0.3–0.6% of C, 0.2–1.0% of Si, 0.8–1.5% of Mn, 0.04% or less of P, 0.12–0.20% of S, 23–27% of Cr, and 18–22% of Ni, the balance being substantially Fe and inevitable impurities.

In a preferred embodiment, the heat-resistant, high-Cr, high-Ni, austenitic cast steel having weight ratios of Cr/Ni of 1.0–1.5 and Mn/S of 5 or more further comprises 1–4%, more preferably 2.7–3.3%, of Wand/or more than 1% and 4% or less, more preferably 1.8–2.2%, of Nb by weight. Further preferably, the heat-resistant, high-Cr, high-Ni, austenitic cast steel having weight ratios of Cr/Ni of 1.0–1.5 and Mn/S of 5 or more further comprises Mo at a ratio of W=2 Mo. A weight ratio of Cr/Ni is preferably 1.0–1.5. A weight ratio of Mn/S is preferably 5 or more, thereby containing sulfide particles including manganese sulfide.

The heat-resistant, high-Cr, high-Ni, austenitic cast steel having weight ratios of Cr/Ni of 1.0–1.5 and Mn/S of 5 or more preferably has a structure of an austenitic matrix in which fine carbide particles based on chromium are uniformly precipitated.

The exhaust equipment member may be an exhaust manifold, a turbine housing, an exhaust manifold integral with a turbine housing, a catalyst case, or an exhaust manifold integral with a catalyst case.

The internal combustion engine system according to an embodiment of the present invention comprises an engine, an air-intake member connected to the front side of the engine, and the above-described exhaust equipment member connected to the rear side of the engine, wherein at least an exhaust manifold is directly connected to an exhaust gas-purifying apparatus.

The method for producing an exhaust equipment member having an exhaust gas path portion at least partially having a thickness of 5 mm or less according to an embodiment of the present invention comprises the steps of (1) preparing a sand mold having a cavity for receiving a melt of an heat-resistant, high-Cr, high-Ni, austenitic cast steel for forming the exhaust equipment member, a sprue connected to the cavity via a gate, and an air-permeable portion close to a part of the cavity into which the melt flows substantially last and apart from the gate, (2) evacuating the cavity through the air-permeable portion of the sand mold; (3) pouring the melt of an heat-resistant, high-Cr, high-Ni, austenitic cast steel having weight ratios of Cr/Ni of 1.0–1.5 and Mn/S of 5 or more having a composition by weight comprising 0.2–1.0% of C, 2% or less of Si, 2% or less of Mn, 0.04% or less of P, 0.05–0.25% of 5, 20–30% of Cr, and 16–30% of Ni, the balance being substantially Fe and inevitable impurities, into the cavity for casting; and (4) heat-treating the resultant casting, so that it has a structure of an austenitic matrix in which fine carbide particles based on chromium and having an average particle size of 10 $\mu$m or less are uniformly precipitated.

BRIEF DESCRIPTION OF THE DRAWINGS

FIG. 4 (*b*) is a cross-sectional view showing the turbine housing of FIG. 4 (*a*);

DETAILED DESCRIPTION OF THE INVENTION

Figure 1:
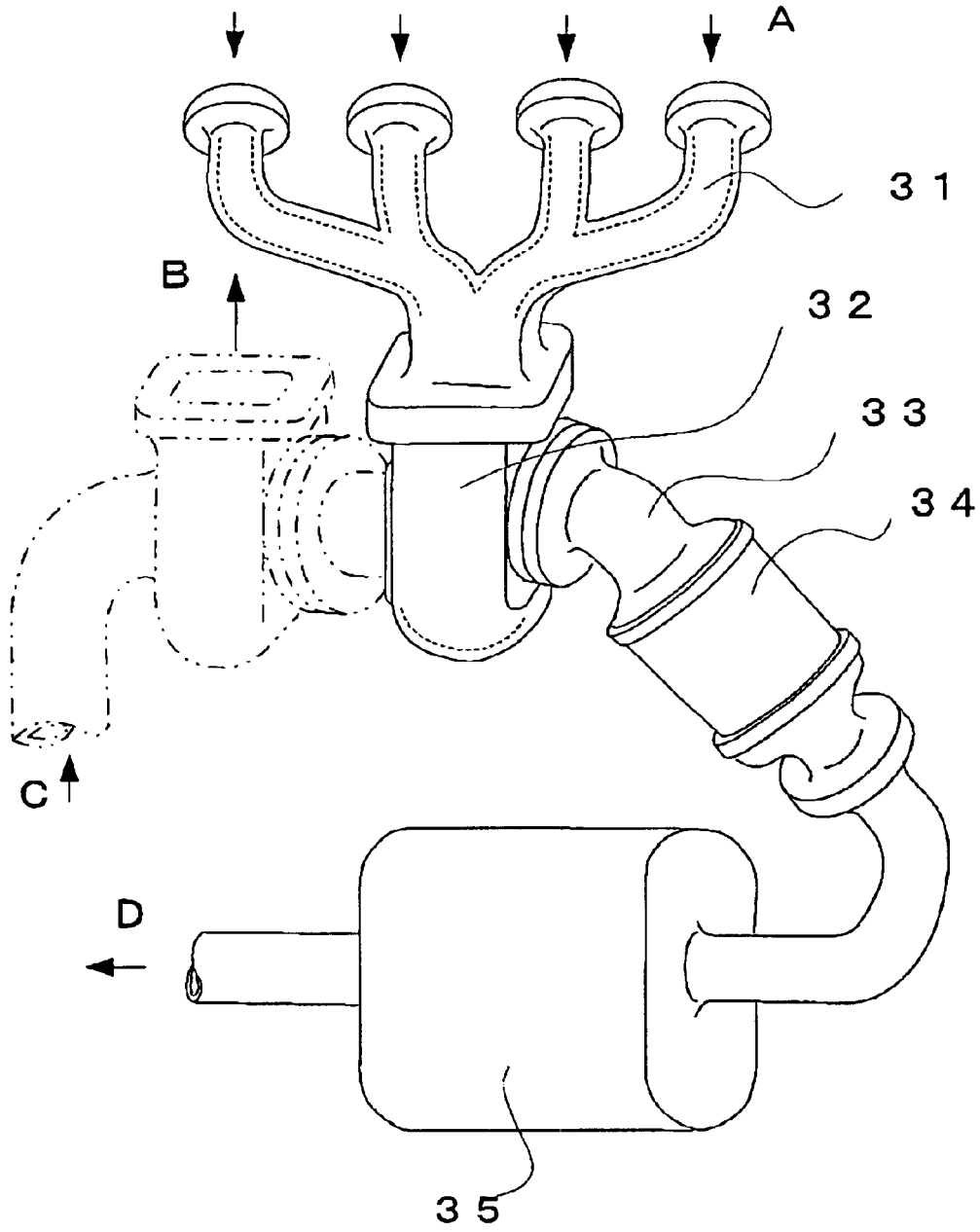
FIG. 1 is a perspective view showing an exhaust system comprising an exhaust manifold, a turbine housing and a catalyst case as exhaust equipment members.

The present invention will be explained in detail below.

[1] Heat-resistant, high-Cr, high-Ni, Austenitic Cast Steel (A) Composition

The heat-resistant, high-Cr, high-Ni, austenitic cast steel preferably has a composition by weight comprising 0.2–1.0% of C, 2% or less of Si, 2% or less of Mn, 0.04% or less of P, 0.05–0.25% of S, 20–30% of Cr, and 16–30% of Ni, the balance being substantially Fe and inevitable impurities.

(1) C(carbon): 0.2–1.0%

C functions to improve the flowability and castability of a melt and partially dissolves into a matrix phase, thereby exhibiting a solution strengthening function. Besides, it forms primary carbides and secondary carbides, thereby improving the high-temperature strength of the austenitic cast steel. When Nb is contained, C forms eutectic carbides with Nb, thereby improving the castability. To exhibit such functions effectively, the amount of C added is preferably 0.2% or more. On the other hand, when the amount of C added exceeds 1.0%, eutectic carbides and other carbides are excessively precipitated, making the austenitic cast steel brittle and poor in elongation and workability. Accordingly, the amount of C added is preferably 0.2–1.0%. The more preferred amount of C added is 0.3–0.6%.

(2) Si (silicon): 2% or less

Si not only functions as a deoxidizer of the melt but also is effective for improving the oxidation resistance of the exhaust equipment member. However, if the amount of Si added is excessive, the austenitic structure is unstable, resulting in deterioration in castability. Accordingly, the amount of Si added is preferably 2% or less. The more preferred amount of Si added is 0.2–1.0%.

(3) Mn (manganese): 2% or less

Mn is effective like Si as a deoxidizer for the melt. However, when it is excessively added, the oxidation resistance of the austenitic cast steel is deteriorated. Accordingly, the amount of Mn added is preferably 2% or less. The more preferred amount of Mn added is 0.8–1.5%.

(4) P (phosphorus): 0.04% or less

Because P lowers the melting point of the heat-resistant, high-Cr, high-Ni, austenitic cast steel, thereby deteriorating the thermal fatigue life of exhaust equipment members used at high temperatures, the amount of P added is preferably as small as possible. Accordingly, the amount of P added is preferably 0.04% or less.

(5) S (sulfur): 0.05–0.25%

S forms spherical or bulky sulfides in the cast steel, thereby improving cuttability by making the cutting of chips easy in machining. To exhibit such functions effectively, the amount of S added is preferably 0.05% or more. On the other hand, the addition of too much S leads to the precipitation of too much sulfides in grain boundaries, thereby deteriorating the high-temperature strength of the exhaust equipment member. Accordingly, the amount of S added is preferably 0.25% at most. Thus, the amount of S added is preferably 0.05–0.25%. The more preferred amount of S added is 0.12–0.2%.

(6) Cr (chromium): 20–30%

Cr is an element capable of austenizing the cast steel structure when it coexists with Ni, thereby improving the high-temperature strength and oxidation resistance of the austenitic cast steel. To exhibit effectively such effects particularly at a high temperature exceeding 1000° C., the amount of Cr added is preferably 20% or more. However, when it exceeds 30%, secondary carbides are excessively precipitated and a brittle $\alpha$-phase, etc. are also precipitated, resulting in extreme brittleness. Accordingly, the amount of Cr added is preferably 20–30%. The more preferred amount of Cr added is 23–27%.

(7) Ni (nickel): 16–30%

Ni is an element effective for forming and stabilizing an austenitic structure of the cast steel together with Cr, thereby improving the castability. Particularly, in order that a thin exhaust equipment member usable at a high temperature exceeding 1000° C. can be cast well, the amount of Ni added is preferably 16% or more. As the amount of Ni increases, such effects increase. However, when it exceeds 30%, the effects level off, meaning that the addition of more Ni is economically disadvantageous. Accordingly, the amount of Ni added is preferably 16–30%. The more preferred amount of Ni is 18–22%.

(8) W (tungsten): 1–4%

W has a function of improving the high-temperature strength. To exhibit such an effect effectively, the amount of W added is preferably 1% or more. However, it is excessively added, the oxidation resistance is deteriorated. Thus, the upper limit of W is preferably 4%. Accordingly, the amount of W added is preferably 1–4%. The more preferred amount of W added is 2.7–3.3%. Because the addition of Mo provides substantially the same effects as those of W, a part or all of W may be substituted by Mo. In this case, the amount of Mo is preferably determined to meet the relation of W=2 Mo.

(9) Nb (niobium): more than 1% to 4% or less

Nb forms fine carbides when combined with C, increasing the tensile strength and thermal fatigue resistance at high temperatures. Also, by suppressing the formation of Cr carbides, Nb functions to improve the oxidation resistance and cuttability of the austenitic cast steel. Further, because Nb forms eutectic carbides, the addition of Nb improves the castability of a thin exhaust equipment member. For such purposes, the amount of Nb added is preferably more than 1%. However, if it is excessively added, too much eutectic carbides are formed in grain boundaries, resulting in brittleness and deterioration of strength and elongation. Therefore, the upper limit of Nb is preferably 4%. Accordingly, the amount of Nb added is preferably more than 1% to 4% or less %. The more preferred amount of Nb is 1.8–2.2%.

(10) Weight ratio of Cr/Ni: 1.0–1.5

As described above, Cr austenizes the cast steel structure together with Ni, thereby improving the high-temperature strength and oxidation resistance of the austenitic cast steel. Ni also improves the castability of the austenitic cast steel. As a weight ratio of Ni to Cr increases, the austenitic cast steel exhibits higher oxidation resistance and high-temperature strength. Such effects, however, are saturated when the weight ratio of Cr/Ni reaches 1.0. On the other hand, when the weight ratio of Cr/Ni exceeds 1.5, secondary Cr carbides are excessively precipitated together with brittle precipitates such as an $\alpha$-phase, resulting in extreme brittleness. Therefore, the weight ratio of Cr/Ni is preferably 1.0–1.5.

(11) Weight ratio of Mn/S: 5% or more

With a weight ratio of Mn/S is 5 or more, and with manganese sulfide included as sulfide particles, the austenitic cast steel exhibits improved cuttability, thereby enabling the production of an exhaust equipment member at a low cost.

(B) Metal structure of austenitic cast steel

The heat-resistant, high-Cr, high-Ni, austenitic cast steel having weight ratios of Cr/Ni of 1.0–1.5 and Mn/S of 5 or more for the exhaust equipment member of the present invention has an austenitic matrix in which fine carbide particles based on chromium are uniformly precipitated. For instance, by a heat treatment comprising heating at a temperature of 700° C. or higher, preferably 700–900° C., more preferably 750–850° C., for 0.5–10 hours, preferably 0.5–5 then cooling in the air, preferably in a furnace, excessive carbon in a carburized layer formed at the time of casting is diffused inside the matrix of the austenitic cast steel, resulting in the precipitation of fine carbide particles based on chromium ($Cr_{23}C_6$) near austenitic grain boundaries. With this metal structure, the exhaust equipment member exhibits improved oxidation resistance when exposed to an exhaust gas at a temperature exceeding 1000° C., or near 1050° C. or 1100° C.

(C) Properties (1) Weight loss by oxidation (a) Weight loss by oxidation at 1010°C. for 200 hours The exhaust equipment member is directly exposed to oxides such as sulfur oxides, nitrogen oxides, etc. contained in an exhaust gas discharged from an engine. If oxidation takes place in the exhaust equipment member, fine cracks are first generated and then grow by successive oxidation. Thus, the exhaust equipment member exposed to an exhaust gas at a temperature exceeding 1000° C. should have a good oxidation resistance. The oxidation resistance of the austenitic cast steel is expressed by weight loss by oxidation (unit: $mg/cm^2$), which is determined by keeping a round rod test piece having a diameter of 10 mm and a length of 20 mm in the air at a temperature exceeding 1000° C. for 200 hours, shot-blasting the test piece to remove oxide scales from a surface, measuring the weight of the test piece before and after the oxidation test, and calculating change in weight of the test piece per a unit area.

The weight loss by oxidation may change drastically even with a temperature elevation of as small as 10° C., when the heating temperature is higher than 1000° C. Therefore, the weight loss by oxidation at 1010° C. is an important parameter of oxidation resistance. In the present invention, the weight loss by oxidation of the exhaust equipment member should be 50 mg/cm$^2$ or less when kept in the air at 1010° C. for 200 hours. With this oxidation resistance, the exhaust equipment member can be used with an exhaust gas at a temperature exceeding 1000° C.

(b) Weight Loss by Oxidation at 1050° C. for 200 hours

The higher the temperature of an exhaust gas, the more oxidation the exhaust equipment member suffers from. Accordingly, in order to use the exhaust equipment member for an internal combustion engine system generating a higher-temperature exhaust gas, the exhaust equipment member preferably has a weight loss by oxidation of 100 mg/cm$^2$ or less when kept in the air at 1050° C. for 200 hours.

(c) Weight Loss by Oxidation at 1100° C. for 200 hours

When kept in the air at 1100° C. for 200 hours, the exhaust equipment member preferably has a weight loss by oxidation of 200 mg/cm$^2$ or less. This exhaust equipment member can be used under the conditions that it is exposed to an exhaust gas at a temperature near 1100° C. If the weight loss by oxidation is small at any temperature from 1000° C. to 1100° C., the exhaust equipment member exhibits excellent durability when used at such a temperature.

(2) Thermal Fatigue Life (a) At Constraint Ratio of 0.25

The exhaust equipment member should have a good thermal fatigue life because it is subjected to repeated heating and cooling by the start and stop of an engine. The thermal fatigue life is measured on a round rod test piece having a gauge length of 25 mm and a diameter of 10 mm in the gauge length, by the steps of mounting the test piece to an electric-hydraulic, servo-type thermal fatigue tester, repeatedly subjecting the test piece to a heating-cooling cycle under the conditions of the highest heating temperature of 1000° C., a temperature amplitude of 800° C. or more, and one cycle of 12 minutes, in a state where the thermal elongation and shrink of the test piece is mechanically constrained, thereby causing thermal fatigue failure in the test piece. When the test piece is totally free in thermal elongation or shrinking, the constraint ratio is defined as "0."Also, when the test piece is completely constrained so that no thermal elongation or shrinking is allowed during the thermal fatigue test, the constraint ratio is defined as "1.0."

Usually, the exhaust equipment members such as turbine housings, exhaust manifolds, catalyst cases, etc. are not completely constrained in terms of thermal elongation and shrinking, and thus the constraint ratio is not 1.0. Instead, elongation and shrinking by heating and cooling are allowed to some extent, for instance, at a constraint ratio of about 0.5, in the actual exhaust equipment member. The high-temperature strength affects the durability of the exhaust equipment member at a constraint ratio of 1.0, while oxidation and thermal cracking by operation for a long period of time affect the durability of the exhaust equipment member at a constraint ratio of near 0.5. Also, if the thermal fatigue life at a constraint ratio of 0.25 were 200 cycles or more, the exhaust equipment member would be able to be used in a state where it is exposed to an exhaust gas at temperatures exceeding 1000° C., near 1050° C. and further near 1100° C.

(b) At Constraint Ratio of 0.5

When the thermal fatigue life is 100 cycles or more at a constraint ratio of 0.5, the exhaust equipment member can also be used in a state where it is exposed to an exhaust gas at temperatures exceeding 1000° C., near 1050° C. and further near 1100° C.

[2] Structure of Exhaust Equipment Member

The exhaust equipment member of the present invention may be an exhaust manifold, a turbine housing, a catalyst case, or a combination thereof. In the case of combination, an exhaust manifold integral with a turbine housing, an exhaust manifold integral with a catalyst case, etc. are preferable. To maintain the maximum performance of the exhaust gas-purifying catalyst contained in the catalyst case disposed downstream of the exhaust manifold, etc., the exhaust manifold, the turbine housing etc. are preferably connected to on the rear side of an engine, because the catalyst case should be positioned on the rear side of the engine. With such an arrangement, however, the exhaust equipment members are less brought into contact with the wind, so that they suffer from higher temperature elevation. Therefore, the exhaust equipment member of the present invention disposed on the rear side of an engine enables should have high heat resistance such as oxidation resistance, high-temperature strength, etc. To meet these requirements, the exhaust equipment member is made of a heat-resistant, high-Cr, high-Ni, austenitic cast steel having weight ratios of Cr/Ni of 1.0–1.5 and Mn/S of 5 or more excellent oxidation resistance when exposed to an exhaust gas at a temperature exceeding 1000° C., near 1050° C. and further near 1100° C.

Next, if the exhaust equipment member had a large heat capacity, the heat of the exhaust gas would be removed by the exhaust equipment member, thereby resulting in decrease in the initial performance of the exhaust gas-purifying catalyst. When a portion of the exhaust equipment member through which an exhaust gas flows, namely an exhaust gas path portion, at least partially has a thickness of 5 mm or less, preferably 2–4 mm, a good initial performance of the exhaust gas-purifying catalyst can be achieved.

[3] Production of Exhaust Equipment Member

The exhaust equipment member having an exhaust gas path portion at least partially having a thickness of 5 mm or less can be produced by a vacuum casting method. A sand mold for the vacuum casting method has a cavity for forming the exhaust equipment member, a sprue connected to the cavity via a gate, and an air-permeable portion close to a part of the cavity into which a melt flows substantially last and apart from the gate. While evacuating the cavity of the sand mold through the air-permeable portion, a melt of a heat-resistant, high-Cr, high-Ni, austenitic cast steel having weight ratios of Cr/Ni of 1.0–1.5 and Mn/S of 5 or more is poured into the cavity for casting. With increased flowability by evacuation, the melt can flow into as thin portions of the cavity as 5 mm or less without generating defects such as voids.

The resultant casting is heat-treated under the conditions of a temperature of 700° C. or higher, preferably 700–900° C., more preferably 750–850° C., for 0.5–10 hours, preferably 0.5–5 hours. After the heat treatment, the casting is cooled in the air, preferably gradually cooled in a furnace. The thus produced exhaust equipment member has a structure of an austenitic matrix in which fine carbide particles based on chromium and having an average particle size of 10 $\mu$m or less are uniformly precipitated.

The present invention will be explained in detail by way of the following Examples without intention of restricting the scope of the present invention thereto.

EXAMPLE 1, COMPARATIVE EXAMPLES 1 AND 2

Various types of austenitic cast steel having compositions shown in Table 1 below were melted at 1550° C. or higher in a 100-kg-capacity, high-frequency furnace in the air. The melt discharged from the high-frequency furnace was immediately poured at 1500° C. or higher into the cavity of the sand mold though the sprue to cast block test pieces of 25 mm×25 mm×165 mm.

TABLE 1

| | Chemical Composition (weight %) | | | | | | | | | | |
|---|---|---|---|---|---|---|---|---|---|---|---|
| No. | C | Si | Mn | P | S | Cr | Ni | W | Nb | Cr/Ni | Mn/S |
| 1 | 0.30 | 0.54 | 1.02 | 0.03 | 0.16 | 24.9 | 20.3 | — | — | 1.2 | 6.4 |
| 2 | 0.25 | 0.53 | 0.95 | 0.03 | 0.15 | 23.7 | 20.9 | — | — | 1.1 | 6.3 |
| 3 | 0.35 | 0.58 | 1.03 | 0.03 | 0.15 | 26.0 | 19.3 | — | — | 1.3 | 6.9 |
| 4 | 0.33 | 0.50 | 0.56 | 0.03 | 0.10 | 25.2 | 19.9 | — | — | 1.3 | 6.9 |
| 5 | 0.30 | 0.56 | 1.03 | 0.03 | 0.15 | 25.3 | 20.8 | — | — | 1.2 | 6.9 |
| 6 | 0.44 | 0.50 | 0.96 | 0.03 | 0.15 | 25.1 | 19.8 | 3.0 | 2.0 | 1.3 | 6.4 |
| 7 | 0.46 | 0.60 | 1.02 | 0.03 | 0.15 | 25.0 | 18.0 | 3.0 | 2.0 | 1.4 | 6.8 |
| 8 | 0.39 | 0.55 | 1.00 | 0.03 | 0.14 | 25.0 | 20.4 | — | — | 1.2 | 7.1 |
| 9 | 0.46 | 0.50 | 0.96 | 0.03 | 0.16 | 25.4 | 20.1 | — | — | 1.3 | 6.0 |
| 10 | 0.45 | 0.50 | 1.00 | 0.03 | 0.15 | 25.0 | 20.0 | — | 2.0 | 1.3 | 6.7 |
| 11 | 0.50 | 0.50 | 0.91 | 0.03 | 0.15 | 24.5 | 19.7 | — | — | 1.2 | 6.1 |
| 12 | 0.52 | 0.55 | 0.95 | 0.03 | 0.16 | 24.9 | 18.2 | 3.0 | 2.0 | 1.3 | 5.9 |
| 13 | 0.55 | 0.95 | 1.00 | 0.03 | 0.15 | 25.0 | 20.0 | 3.0 | 2.0 | 1.3 | 6.7 |
| 14* | 0.38 | 0.92 | 0.46 | 0.03 | 0.04 | 19.5 | 9.3 | 2.1 | 0.5 | 2.1 | 11.5 |
| 15* | 0.47 | 0.72 | 1.04 | 0.03 | 0.17 | 20.1 | 10.0 | 3.0 | 2.0 | 2.0 | 6.1 |

Note: Sample No. 14: COMPARATIVE EXAMPLE 1, a heat-resistant, austenitic cast steel disclosed in Japanese Patent Laid-Open No. 5-5161.

Sample No. 15: COMPARATIVE EXAMPLE 2, a heat-resistant, austenitic cast steel disclosed in Japanese Patent Laid-Open No. 7-228948.

Each block test piece of 25 mm×25 mm×165 mm was subjected a heat treatment by keeping at 800° C. for 2 hours in a furnace and then cooling in the furnace. Each test piece was then measured with respect to the following properties.

(1) Weight Loss by Oxidation

Because the exhaust equipment member is directly exposed to oxides such as sulfur oxides, nitrogen oxides, etc. contained in an exhaust gas discharged from an engine, it is required to have good oxidation resistance. In view of the fact that the exhaust equipment member is likely to be exposed to an exhaust gas at a temperature exceeding 1000° C., near 1050° C. or further near 1100° C., oxidation resistance was evaluated at these temperatures.

A round rod test piece made of each austenitic cast steel of Sample Nos. 1–15 and having a diameter of 10 mm and a length of 20 mm was kept in the air at 1000° C., 1010° C., 1050° C. and 1100° C., respectively, for 200 hours, and its oxide scales were removed by shot blasting to measure weight variation per a unit surface area. By calculating weight loss by oxidation (mg/cm$^2$) after the oxidation test, the oxidation resistance of each test piece was evaluated. The results are shown in Table 2.

TABLE 2

| | Weight Loss By Oxidation (mg/cm$^2$) | | | |
|---|---|---|---|---|
| No. | At 1000° C. | At 1010° C. | At 1050° C. | At 1100° C. |
| 1 | 11 | 13 | 16 | 120 |
| 2 | 12 | 14 | 15 | 131 |

TABLE 2-continued

| | Weight Loss By Oxidation (mg/cm$^2$) | | | |
|---|---|---|---|---|
| No. | At 1000° C. | At 1010° C. | At 1050° C. | At 1100° C. |
| 3 | 11 | 13 | 15 | 154 |
| 4 | 11 | 15 | 17 | 102 |
| 5 | 15 | 16 | 17 | 97 |

TABLE 2-continued

| | Weight Loss By Oxidation (mg/cm$^2$) | | | |
|---|---|---|---|---|
| No. | At 1000° C. | At 1010° C. | At 1050° C. | At 1100° C. |
| 6 | 17 | 18 | 21 | 140 |
| 7 | 13 | 15 | 17 | 155 |
| 8 | 15 | 18 | 21 | 72 |
| 9 | 16 | 17 | 19 | 32 |
| 10 | 7 | 12 | 20 | 35 |
| 11 | 14 | 35 | 52 | 105 |
| 12 | 13 | 25 | 30 | 120 |
| 13 | 24 | 27 | 44 | 62 |
| 14* | 44 | 133 | 442 | 967 |
| 15* | 37 | 121 | 888 | 1065 |

Note: Sample No. 14: COMPARATIVE EXAMPLE 1.
Sample No. 15: COMPARATIVE EXAMPLE 2.

It is clear from Table 2 that the test pieces of Sample Nos. 1–13 (EXAMPLE 1) suffer from only small weight loss by oxidation at any temperature of 1000° C., 1010° C., 1050° C. and 1100° C., with smaller increment in weight loss by oxidation with temperature elevation. On the other hand, in Sample Nos. 14 and 15 (COMPARATIVE EXAMPLES 1 and 2), the weight loss by oxidation drastically increases as the temperature is elevated to 1010° C., 1050° C. and 1100° C., though the difference in weight loss by oxidation between Sample Nos. 1–13 and Sample Nos. 14 and 15 is relatively small at 1000° C. These results verify that with respect to the exhaust equipment member exposed to an exhaust gas at a temperature exceeding 1000° C., near 1050° C. and further near 1100° C., Sample Nos. 1–13 of the present invention are much superior to Sample Nos. 14 and 15 of COMPARATIVE EXAMPLES 1 and 2.

(2) Thermal Fatigue Life

The exhaust equipment member should have enough thermal fatigue life, because it is repeatedly subjected to a heat cycle due to the start and stop of an engine. To measure the thermal fatigue life, a round rod test piece having a gauge length of 25 mm and a diameter of 10 mm in the gauge length was mounted to an electric-hydraulic, servo-type thermal fatigue tester, and repeatedly subjected to a heating-cooling cycle under the conditions of the lowest heating temperature of 150° C., the highest heating temperature of 1000° C., and one cycle of 12 minutes, in a state where the thermal elongation and shrink of the test piece was mechanically constrained, thereby causing thermal fatigue failure at a constraint ratio of 0.25 and 0.5, respectively. The results are shown in Table 3 below.

(3) Yield Strength at High Temperature

To have high resistance to deformation at high temperatures, the exhaust equipment member should have as high yield strength as possible at high temperatures. 0.2-% yield strength was measured on a flanged test piece (gauge length: 50 mm, diameter in gauge length: 10 mm) at 1050° C. The results are shown in Table 3 below.

TABLE 3

| | Thermal Fatigue Life (cycles) | | Yield Strength |
|---|---|---|---|
| No. | Constraint Ratio = 0.25 | Constraint Ratio = 0.5 | at 1050° C. ($N/mm^2$) |
| 1 | 323 | 246 | 51 |
| 2 | 378 | 203 | 53 |
| 3 | 231 | 123 | 50 |
| 4 | 358 | 253 | 49 |
| 5 | 376 | 276 | 56 |
| 6 | 214 | 126 | 55 |
| 7 | 231 | 153 | 53 |
| 8 | 894 | 315 | 50 |
| 9 | 1189 | 299 | 51 |
| 10 | 643 | 271 | 52 |
| 11 | 677 | 302 | 50 |
| 12 | 402 | 311 | 52 |
| 13 | 805 | 656 | 58 |
| 14* | 274 | 260 | 58 |
| 15* | 486 | 194 | 51 |

Note: Sample No. 14: COMPARATIVE EXAMPLE 1.
Sample No. 15: COMPARATIVE EXAMPLE 2.

It is clear from Table 3 that Sample Nos. 1–13 had as good thermal fatigue life as that of Sample Nos. 14 and 15 at both constraint ratios of 0.25 and 0.5, respectively. It is also clear from Table 3 that Sample Nos. 1–13 had as good high-temperature yield strength as that of Sample Nos. 14 and 15.

EXAMPLE 2, COMPARATIVE EXAMPLE 3

FIG. 1 is a perspective view showing an exhaust equipment member comprising an exhaust manifold 31, a turbine housing 32 and a catalyst case 34. An exhaust gas (indicated by the arrow A) discharged from an engine (not shown) is gathered in the exhaust manifold 31 to rotate a turbine (not shown) in the turbine housing 32 by the kinetic energy of the exhaust gas. As a result, a compressor coaxially connected to the turbine is driven to compress air supplied to the turbine housing 32 as shown by the arrow C and supply the compressed air to the engine as shown by the arrow B, thereby increasing the output of the engine. On the other hand, contaminants in the exhaust gas from the turbine housing 32 are supplied via a connecting pipe 33 to the catalyst case 34 in which they are removed by a catalyst. The exhaust gas then passes through a muffler 35 to be discharged to the air (indicated by the arrow D). An exhaust gas path portions are formed in the exhaust manifold 31, the turbine housing 32, the connecting pipe 33 and the catalyst case 34, respectively, and each exhaust gas path portion is at least partially as thin as 5 mm or less. Specifically, the thickness of the exhaust gas path portion is mostly 2.0–2.5 mm for the exhaust manifold, 2.5–3.5 mm for the turbine housing 32, 2.5–3.5 mm for the connecting pipe 33, and 2.0–2.5 mm for the catalyst case 34.

Figure 3:
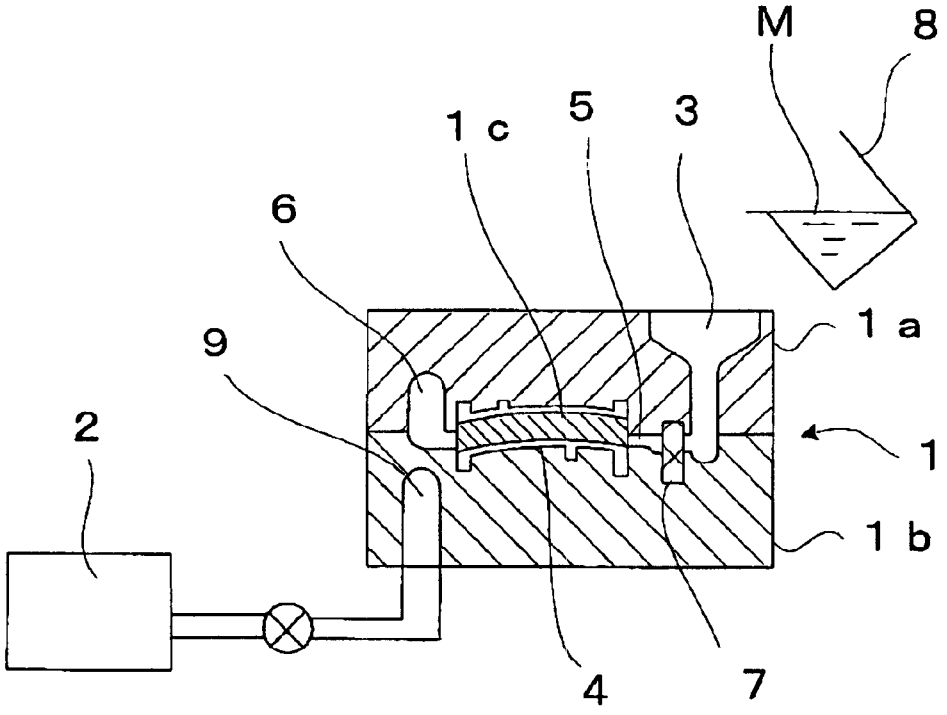
FIG. 3 is a cross-sectional view showing an apparatus for vacuum-casting the exhaust equipment member.

The production of an exhaust manifold 31 is as follows: FIG. 3 is a cross-sectional view showing an apparatus for casting the exhaust manifold 31. The sand mold 1 has a cavity 4 for forming the exhaust manifold 31 having exhaust gas path portions whose main portions are as thin as 2.0–2.5 mm. The cavity 4 is communicating with a sprue 3 via a gate 5, and a riser or feeder 6 is formed in the sand mold at a position apart from the gate 5 connected to the cavity 4. Formed near the riser 6 in the sand mold 1 is an open hole or recess 9. Incidentally, 1*a* indicates a top part of the sand mold 1, 1*b* indicates a bottom part of the sand mold 1, 1*c* indicates a core, and 7 indicates a filter.

A heat-resistant, high-Cr, high-Ni, austenitic cast steel having a composition of Sample No. 7 in Table 1 was melted in a 100-kg-capacity, high-frequency furnace in the air and transferred to a ladle 8 at 1550° C. or higher. While evacuating the cavity 4 of the sand mold 1 though the hole 9 by a vacuum apparatus 2, the melt M from the ladle 8 was poured at 1500° C. or higher into the cavity 4 of the sand mold 1 though the sprue 3. The melt M flowed well at the time of casting, thereby avoiding casting defects such as voids.

The resultant casting was heated at 800° C. for 2 hours and then cooled in a furnace. By this heat treatment, excessive carbon in a carburized layer formed at the time of casting was diffused inside the matrix of the austenitic cast steel, resulting in the precipitation of fine carbide particles based on chromium ($Cr_{23}C_6$) near austenitic grain boundaries. The heat-treated casting was then machined to an exhaust manifold 31. As a result of evaluation of the cuttability, no problem was found at all.

Figure 4A:
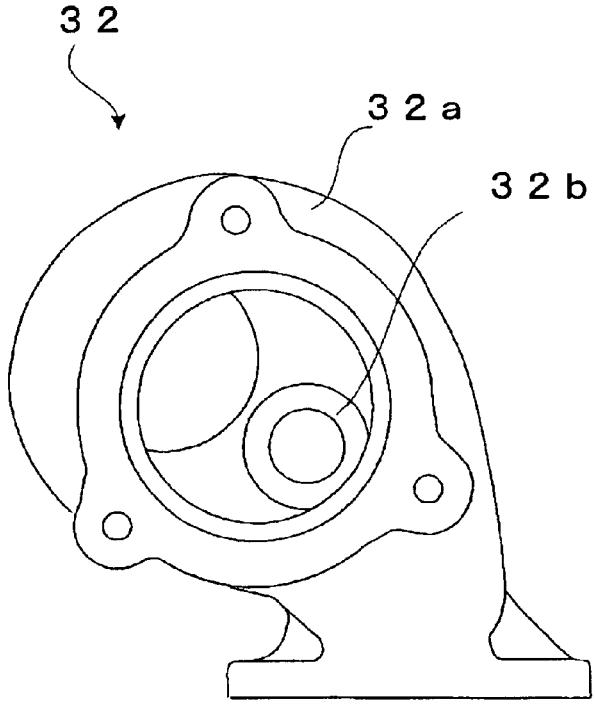
FIG. 4 (*a*) is a side view showing a turbine housing.
Figure 4B:
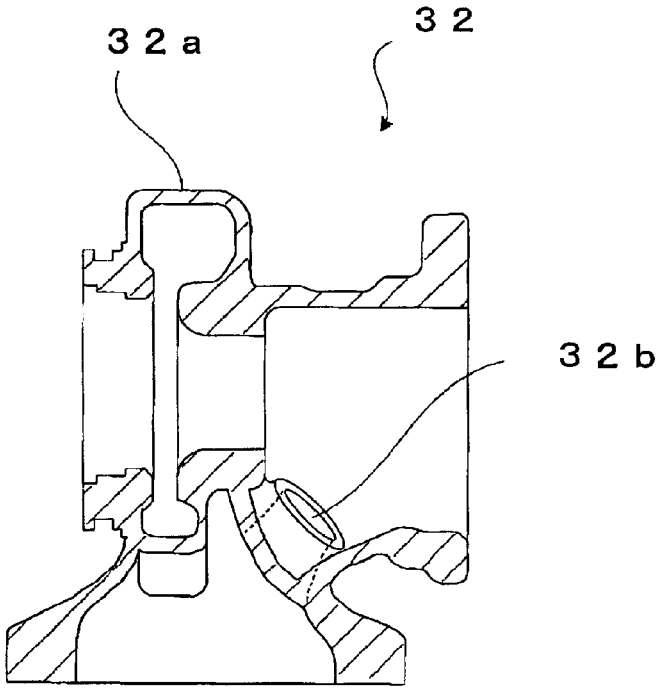

FIGS. 4(*a*) and (*b*) show a turbine housing 32. The turbine housing 32 has a spiral-shaped scroll 32 a for providing a chamber having a cross-sectional area increasing gradually from one end to the other. The turbine housing 32 is provided with a waste gate 32*b* for bypassing the exhaust gas by opening or shutting a valve. This waste gate 32*b* is required to have particularly high oxidation resistance because a high-temperature exhaust gas passes through it. Such a turbine housing 32 and further a catalyst case 34 can be produced from a heat-resistant, high-Cr, high-Ni, austenitic cast steel having a composition of Sample No. 9, like the exhaust manifold 31. Incidentally, as long as die part matching is available, it is possible to produce an exhaust manifold 31 integrally cast with a turbine housing 32, and an exhaust manifold 31 integrally cast with a catalyst case 34 without a turbine housing 32 interposed therebetween.

Next, the exhaust manifold 31 and the turbine housing 32 were connected to an exhaust simulator generating an exhaust gas corresponding to that of a high-performance, 2000-cc, straight four-cylinder gasoline engine to carry out a durability test. For the durability test, 1500 heating-cooling cycles each consisting of 10 minutes of heating and 10 minutes of cooling were conducted. The exhaust gas temperature at a full load was 1080° C. at an inlet of the turbine housing 32. Under this condition, a surface temperature was about 1000° C. in a convergence portion of the exhaust manifold 31, and about 1050° C. at the waste gate 32*b* of the turbine housing 32.

Figure 5:
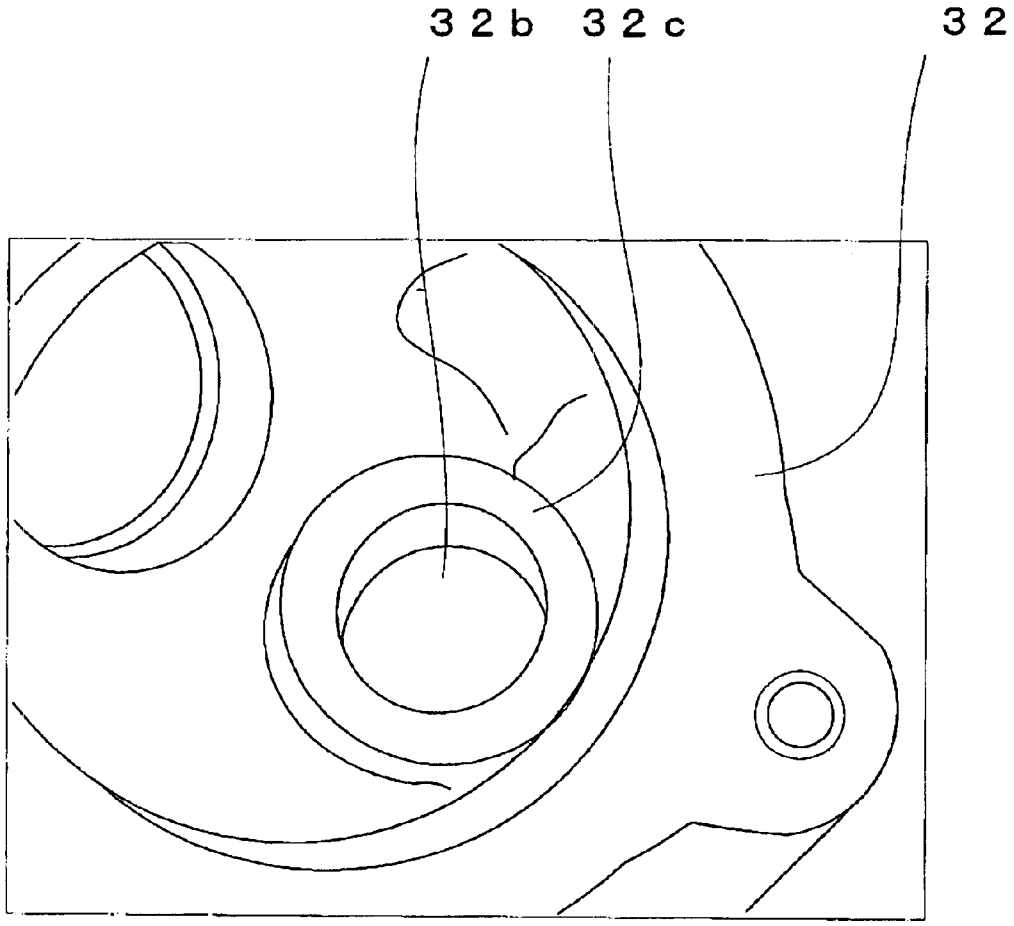
FIG. 5 is a schematic view showing a waste gate of the turbine housing tested in EXAMPLE 2.

FIG. 5 schematically shows the tested waste gate 32*b* of the turbine housing 32. As shown in FIG. 5, even the waste gate 32*b* through which particularly high-temperature exhaust gas passed was little oxidized, suffering from no thermal cracking and deformation that might lead to leaking. It was thus confirmed that the exhaust equipment member of the present invention was excellent in oxidation resistance and thus durability and reliability.

Figure 6:
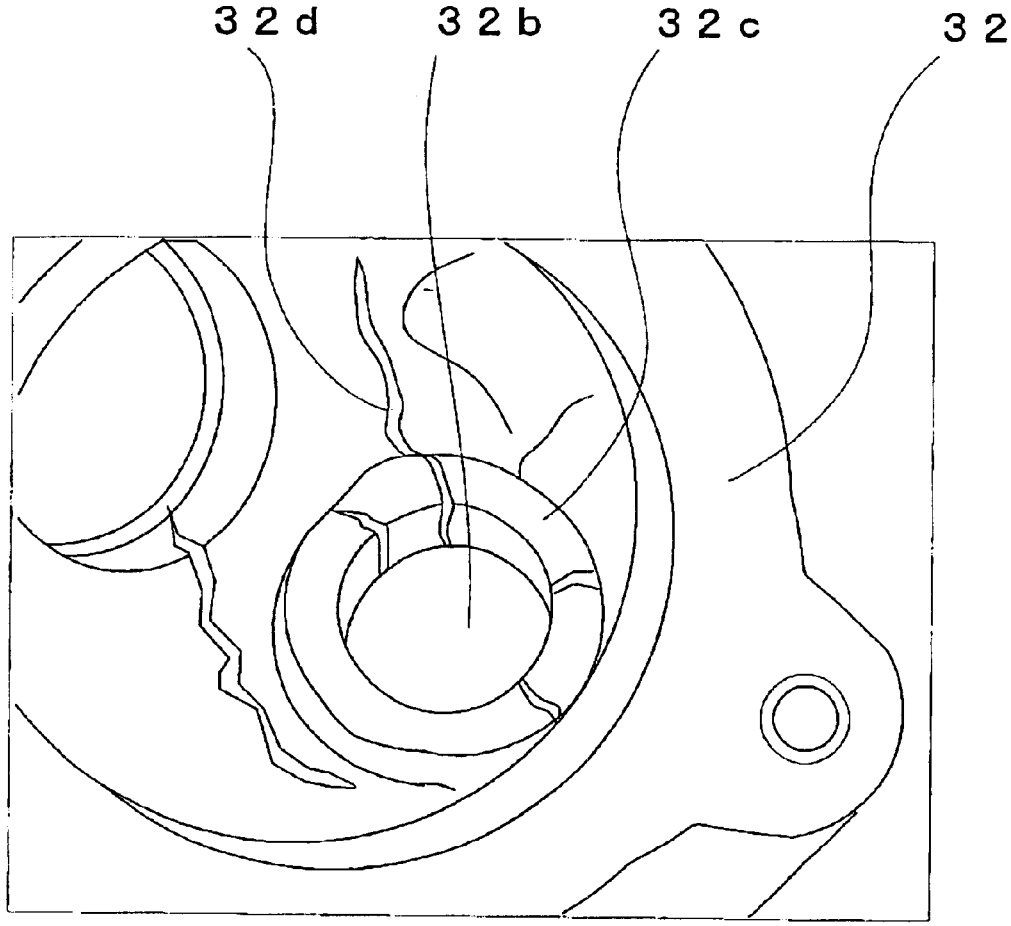
FIG. 6 is a schematic view showing a waste gate of the turbine housing tested in COMPARATIVE EXAMPLE 3.

For comparison, a turbine housing 32 produced from a heat-resistant, austenitic cast steel having a composition of Sample No. 15 in Table 1 was assembled to an exhaust manifold 31, to carry out a durability test using the same exhaust simulator as in EXAMPLE 2. As a result, drastic oxidation proceeded in the turbine housing 32, and a large crack 32*d* was generated in the waste gate 32*b* by 50 cycles as schematically shown in FIG. 6. It was thus confirmed that the turbine housing 32 of EXAMPLE 2 produced from the heat-resistant, high-Cr, high-Ni, austenitic cast steel of Sample No. 9 showed much higher durability than that of COMPARATIVE EXAMPLE 3 produced from the austenitic cast steel of Sample No. 15.

EXAMPLE 3

Figure 2:
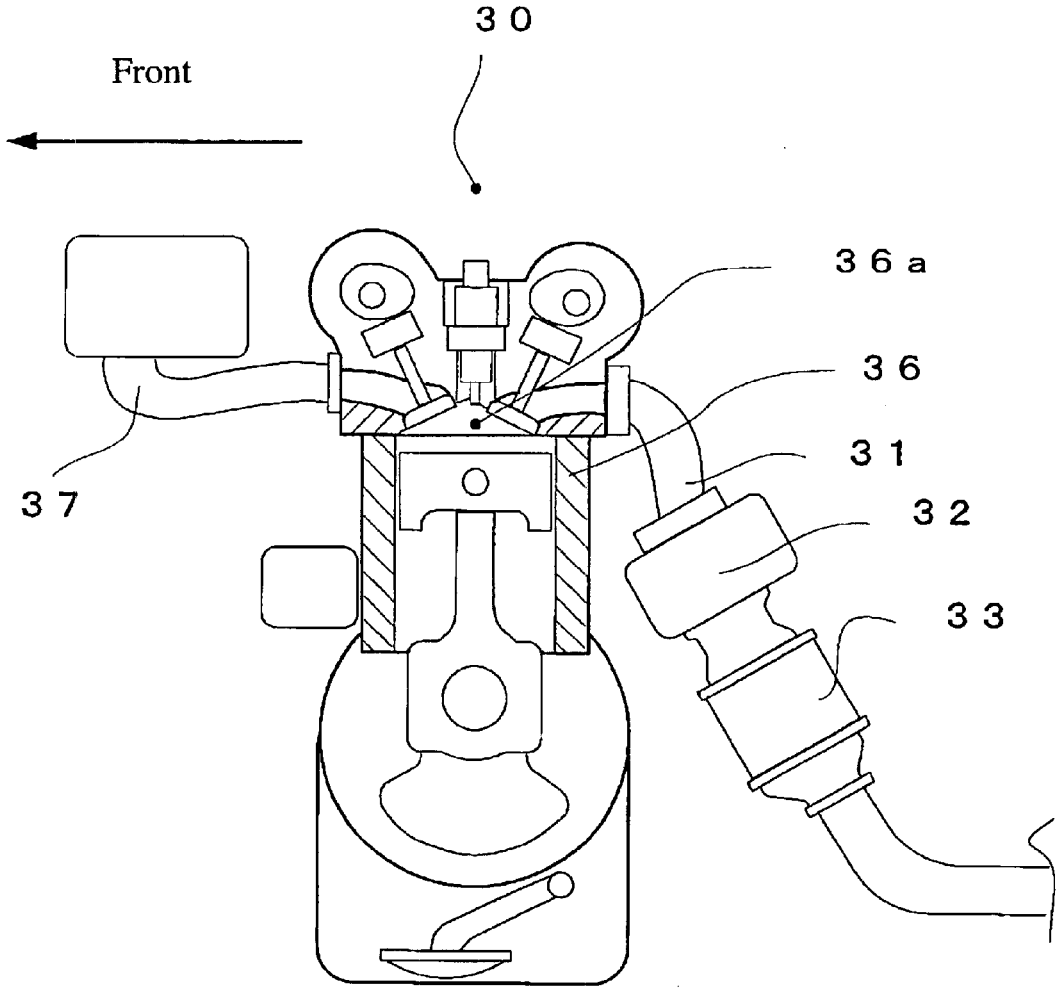
FIG. 2 is a cross-sectional view showing an internal combustion engine system comprising an engine, an air-intake member connected to the front side of the engine, and exhaust equipment members connected to the rear side of the engine.

FIG. 2 schematically shows a transverse-type internal combustion engine 30 using the exhaust equipment member of the present invention. The internal combustion engine 30 has an engine 36, an air-intake member 37 connected to the front side of the engine 36, exhaust equipment members (an exhaust manifold 31, a turbine housing 32 and a catalyst case 34) connected to the rear side of the engine 36. Because cooled air is supplied to a combustion chamber 36*a* of the engine 36 from the air-intake member 37 positioned in front of the engine 36, the temperature elevation of the intake air can be suppressed, thereby increasing the density of the intake air. Further, because the exhaust equipment member is positioned on the rear side of the engine 36, temperature decrease in the exhaust gas temperature is little, thereby improving the initial performance of an exhaust gas-purifying catalyst at the time of starting the engine 36.

As described above in detail, the exhaust equipment member of the present invention is produced from a heat-resistant, high-Cr, high-Ni, austenitic cast steel having weight ratios of Cr/Ni of 1.0–1.5 and Mn/S of 5 or more, excellent in oxidation resistance and durability when exposed to an exhaust gas at a temperature exceeding 1000° C., near 1050° C. and further near 1100 ° C. The internal combustion engine system comprising such an exhaust equipment member exhibits high performance and is excellent in the ability to purify the exhaust gas. The exhaust equipment member of the present invention can be produced by a vacuum casting method and a heat treatment.

What is claimed is:

1. An exhaust equipment member having an exhaust gas path portion at least partially having a thickness of 5 mm or less, said exhaust equipment member being made of a heat-resistant, high-Cr, high-Ni, austenitic cast steel having weight ratios of Cr/Ni of 1.0–1.5 and of Mn/S of 5 or more, with a weight loss by oxidation of 50 mg/cm$^2$ or less when kept in the air at 1010° C. for 200 hours.

2. The exhaust equipment member according to claim 1, wherein it has a thermal fatigue life of 200 cycles or more in a thermal fatigue test in which heating and cooling are repeated under the conditions of the highest heating temperature of 1000° C., a temperature amplitude of 800° C. or more and a constraint ratio of 0.25.

3. The exhaust equipment member according to claim 1, wherein it has a thermal fatigue life of 100 cycles or more in a thermal fatigue test in which heating and cooling are repeated under the conditions of the highest heating temperature of 1000° C., a temperature amplitude of 800° C. or more and a constraint ratio of 0.5.

4. The exhaust equipment member according to claim 1, wherein said heat-resistant, high-Cr, high-Ni, austenitic cast steel has a composition by weight comprising 0.2–1.0% of C, 2% or less of Si, 2% or less of Mn, 0.04% or less of P, 0.05–0.25% of S, 20–30% of Cr, and 16–30% of Ni, the balance being substantially Fe and inevitable impurities.

5. The exhaust equipment member according to claimed 4, wherein said heat-resistant, high-Cr, high-Ni, austenitic cast steel has a composition by weight comprising 0.3–0.6% of C, 0.2–1.0% of Si, 0.8–1.5% of Mn, 0.04% or less of P, 0.12–0.20% of S, 23–27% of Cr, and 18–22% of Ni, the balance being substantially Fe and inevitable impurities.

6. The exhaust equipment member according to claim 4, wherein said heat-resistant, high-Cr, high-Ni, austenitic cast steel further comprises 1–4% of W and/or more than 1% and 4% or less of Nb by weight.

7. The exhaust equipment member according to claim 6, wherein said heat-resistant, high-Cr, high-Ni, austenitic cast steel comprises 2.7–3.3% of W and/or 1.8–2.2% of Nb by weight.

8. The exhaust equipment member according to claim 6, wherein said heat-resistant, high-Cr, high-Ni, austenitic cast steel further comprises Mo at a ratio of W=2 Mo.

9. The exhaust equipment member according to claim 4, wherein said heat-resistant, high-Cr, high-Ni, austenitic cast steel has a structure of an austenitic matrix in which fine carbide particles based on chromium are uniformly precipitated.

10. The exhaust equipment member according to claim 1, wherein it is in the form of a turbine housing.

11. The exhaust equipment member according to claim 1, wherein it is in the form of an exhaust manifold.

12. The exhaust equipment member according to claim 1, wherein it is in the form of an exhaust manifold integral with a turbine housing.

13. The exhaust equipment member according to claim 1, wherein it is in the form of a catalyst case.

14. The exhaust equipment member according to claim 1, wherein it is in the form of an exhaust manifold integral with a catalyst case.

15. An internal combustion engine system having an engine, an air-intake member connected to said engine on the front side, and the exhaust equipment member according to claim 1 connected to said engine on the rear side, wherein at least an exhaust manifold is directly connected to an exhaust gas-purifying apparatus.

16. The exhaust equipment member having an exhaust gas path portion at least partially having a thickness of 5 mm or less according to claim 1, said exhaust equipment member having been heated-treated at a temperature of 700–900° C. for 0.5–10 hours.

17. An exhaust equipment member having an exhaust gas path portion at least partially having a thickness of 5 mm or less, said exhaust equipment member being made of a heat-resistant, high-Cr, high-Ni, austenitic cast steel having weight ratios of Cr/Ni of 1.0–1.5 and of Mn/S of 5 or more, with a weight loss by oxidation of 100 mg/cm$^2$ or less when kept in the air at 1050° C. for 200 hours.

18. The exhaust equipment member having an exhaust gas path portion at least partially having a thickness of 5 mm or less according to claim 17, said exhaust equipment member having been heated-treated at a temperature of 700–900° C. for 0.5–10 hours.

19. An exhaust equipment member having an exhaust gas path portion at least partially having a thickness of 5 mm or less, said exhaust equipment member being made of a heat-resistant, high-Cr, high-Ni, austenitic cast steel having weight ratios of Cr/Ni of 1.0–1.5 and of Mn/S of 5 or more, with a weight loss by oxidation of 200 mg/cm$^2$ or less when kept in the air at 1100° C. for 200 hours.

20. The exhaust equipment member having an exhaust gas path portion at least partially having a thickness of 5 mm or less according to claim 19, said exhaust equipment member having been heated-treated at a temperature of 700–900° C. for 0.5–10 hours.

21. An exhaust equipment member having an exhaust gas path portion at least partially having a thickness of 5 mm or less, said exhaust equipment member being made of a heat-resistant, high-Cr, high-Ni, austenitic cast steel having weight ratios of Cr/Ni of 1.0–1.5 and of Mn/S of 5 or more, with a weight loss by oxidation of 50 mg/cm$^2$ or less when kept in the air at 1010° C. for 200 hours, and 100 mg/cm$^2$ or less when kept in the air at 1050° C. for 200 hours.

22. The exhaust equipment member having an exhaust gas path portion at least partially having a thickness of 5 mm or less according to claim 21, said exhaust equipment member having been heated-treated at a temperature of 700–900° C. for 0.5–10 hours.

23. An exhaust equipment member having an exhaust gas path portion at least partially having a thickness of 5 mm or less, said exhaust equipment member being made of a heat-resistant, high-Cr, high-Ni, austenitic cast steel having weight ratios of Cr/Ni of 1.0–1.5 and of Mn/S of 5 or more, with a weight loss by oxidation of 100 mg/cm$^2$ or less when kept in the air at 1050° C. for 200 hours, and 200 mg/cm$^2$ or less when kept in the air at 1100° C. for 200 hours.

24. The exhaust equipment member having an exhaust gas path portion at least partially having a thickness of 5 mm or less according to claim 23, said exhaust equipment member having been heated-treated at a temperature of 700–900° C. for 0. 5–10 hours.

25. An exhaust equipment member having an exhaust gas path portion at least partially having a thickness of 5 mm or less, said exhaust equipment member being made of a heat-resistant, high-Cr, high-Ni, austenitic cast steel having weight ratios of Cr/Ni of 1.0–1.5 and of Mn/S of 5 or more, with a weight loss by oxidation of 50 mg/cm$^2$ or less when kept in the air at 1010° C. for 200 hours, 100 mg/cm$^2$ or less when kept in the air at 1050° C. for 200 hours, and 200 mg/cm$^2$ or less when kept in the air at 1100° C. for 200 hours.

26. The exhaust equipment member having an exhaust gas path portion at least partially having a thickness of 5 mm or less according to claim 25, said exhaust equipment member having been heated-treated at a temperature of 700–900° C. for 0.5–10 hours.

* * * * *